United States Patent [19]

Ziuchkovski

[11] Patent Number: 5,010,325

[45] Date of Patent: Apr. 23, 1991

[54] DRIVING NETWORK FOR TFEL PANEL EMPLOYING A VIDEO FRAME BUFFER

[75] Inventor: Michael J. Ziuchkovski, Portland, Oreg.

[73] Assignee: Planar Systems, Inc., Beaverton, Oreg.

[21] Appl. No.: 286,231

[22] Filed: Dec. 19, 1988

[51] Int. Cl.[5] ..... G09G 3/30

[52] U.S. Cl. ..... 340/781; 340/799

[58] Field of Search ..... 340/760, 781, 718, 719, 340/811, 798, 799; 358/59, 56, 230, 241; 315/169.1, 169.3

[56] References Cited

U.S. PATENT DOCUMENTS

| | | | |
|---|---|---|---|
| 4,110,662 | 8/1978 | Greeneich et al. | 340/719 |
| 4,562,435 | 12/1985 | McDonough et al. | 340/799 |
| 4,691,144 | 9/1987 | King et al. | 340/760 |
| 4,736,137 | 4/1988 | Ohwada et al. | 340/781 |
| 4,739,320 | 4/1988 | Dolinar et al. | 340/781 |
| 4,796,231 | 1/1989 | Pinkham | 340/799 |
| 4,837,566 | 6/1989 | Channing et al. | 340/781 |

*Primary Examiner*—Jeffery A. Brier

*Attorney, Agent, or Firm*—Chernoff, Vilhauer, McClung & Stenzel

[57] ABSTRACT

A driving network for a TFEL panel includes a frame capture buffer for flat panels having split-screen architecture to increase the video bandwidth and to allow for a high frame refresh rate without changing the video input rate. Input serial video data is converted to parallel data bits and latched at a predetermined clock rate. The latched data bits are transferred to appropriate buffer memories, one for each independently driven portion of the screen. Writing to the buffer memories and reading data out from the buffer memories occurs at asynchronous rates so that data in smaller bytes may be clocked in at a higher frequency and read out of the buffer memories in larger bytes at a lower frequency. Since data may be processed onto flat screen arrays in multiple bits per clock pulse, the frame repetition rate limitations inherent in processing serial input video data are avoided.

5 Claims, 2 Drawing Sheets

DRIVING NETWORK FOR TFEL PANEL EMPLOYING A VIDEO FRAME BUFFER

BACKGROUND OF THE INVENTION

Background of the Invention

The following invention relates to a driving network for a TFEL panel, and in particular, to a driving network which includes a video frame capture buffer for flat panels having split screen architecture to increase the video bandwidth and to allow for higher frame refresh rates without changing the video input frame rate.

Thin film electroluminescent (TFEL) panels include orthonogonal sets of scanning and data electrodes sandwiching a thin film electroluminescent laminate structure to produce light at pixel points defined by the field-of-view intersections of the scanning and data electrodes. These panels, like conventional cathode ray tubes, accept a conventional video data signal. Because of the way in which a CRT is scanned, the video data is serially input, and the conventional frame repetition rate for this serial input is usually around 60 cycles per second. TFEL screens, however, need not accept the limitation of serially input video data because with some screen architectures, data may be written onto the screen in two or more places simultaneously. An example of such screen architecture is shown in Dolinar, et al., U.S. Pat. No. 4,739,320 entitled ENERGY-EFFICIENT SPLIT-ELECTRODE TFEL PANEL. In this device the data electrodes are divided into top and bottom sets of complimentary pairs which extend slightly less than halfway across the screen towards each other. With this architecture, top and bottom halves of the panel may be written simultaneously. Writing different sections of the panel simultaneously can effectively lower the required data rate for the panel driver ICs. This is because it takes less time to write a complete frame.

SUMMARY OF THE INVENTION

A driving network for an AC TFEL panel employing a video frame buffer includes n sets of independently driven data electrodes. A buffer is provided for each of the n sets to store video data and a clock is provided for placing the data in the buffers at a rate of m bits per clock pulse where the frequency of the clock pulses is fl. Data is extracted from the buffers at a rate of $m \times n$ bits per clock pulse at a different frequency $f_2$ where $f_2$ is less than $f_1$.

Serial video data enters a shift register having m outputs (one per bit of video data). The m outputs are latched in a latching circuit for eventual transfer to the buffers. Video enters the shift register at a nominal video data rate and is latched in the latching circuit at the same rate divided by the number of bits, that is, the serial data clock frequency divided by m. The m outputs of the latch circuit are routed to the appropriate buffer by a logic control circuit where they are stored in a shift register and then written into buffer memory. Other logic circuitry reads the data out of buffer memory, thereby supplying the data to the appropriate set of drivers at the appropriate time. Since the video data is processed out of the buffer memories in parallel, to different portions of the screen simultaneously, the effective read out rate to the TFEL flat panel having a split-screen architecture may be higher than the serial input video rate. This is because the buffers may be written and read asynchronously. Thus, if serial data enters the network at a rate of 70 MHz, and through the buffers it is read out at a rate of 6 MHz, 16 bits at a time, the effective rate at which data is applied to the panel is 96 MHz. This allows for a higher refresh rate for the panel and thus provides a means of achieving brightness control since the brightness of the panel is a direct function of the refresh rate. This is accomplished without attempting to alter the rate at which serial data is provided to the input of the driver network.

It is a principal object of this invention to provide a driver network for a flat panel TFEL display employing a video frame buffer for effectively increasing the frame repetition rate over that which is normally available from a source of serial video data.

A further object of this invention is to provide a video data frame buffer having asynchronous read and write functions for converting serially input video data to parallel data to increase the rate at which data can be provided to a split screen display device.

A still further object of this invention is to provide the capability for increasing the refresh rate of a split screen TFEL display without altering the input video data rate.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 2:
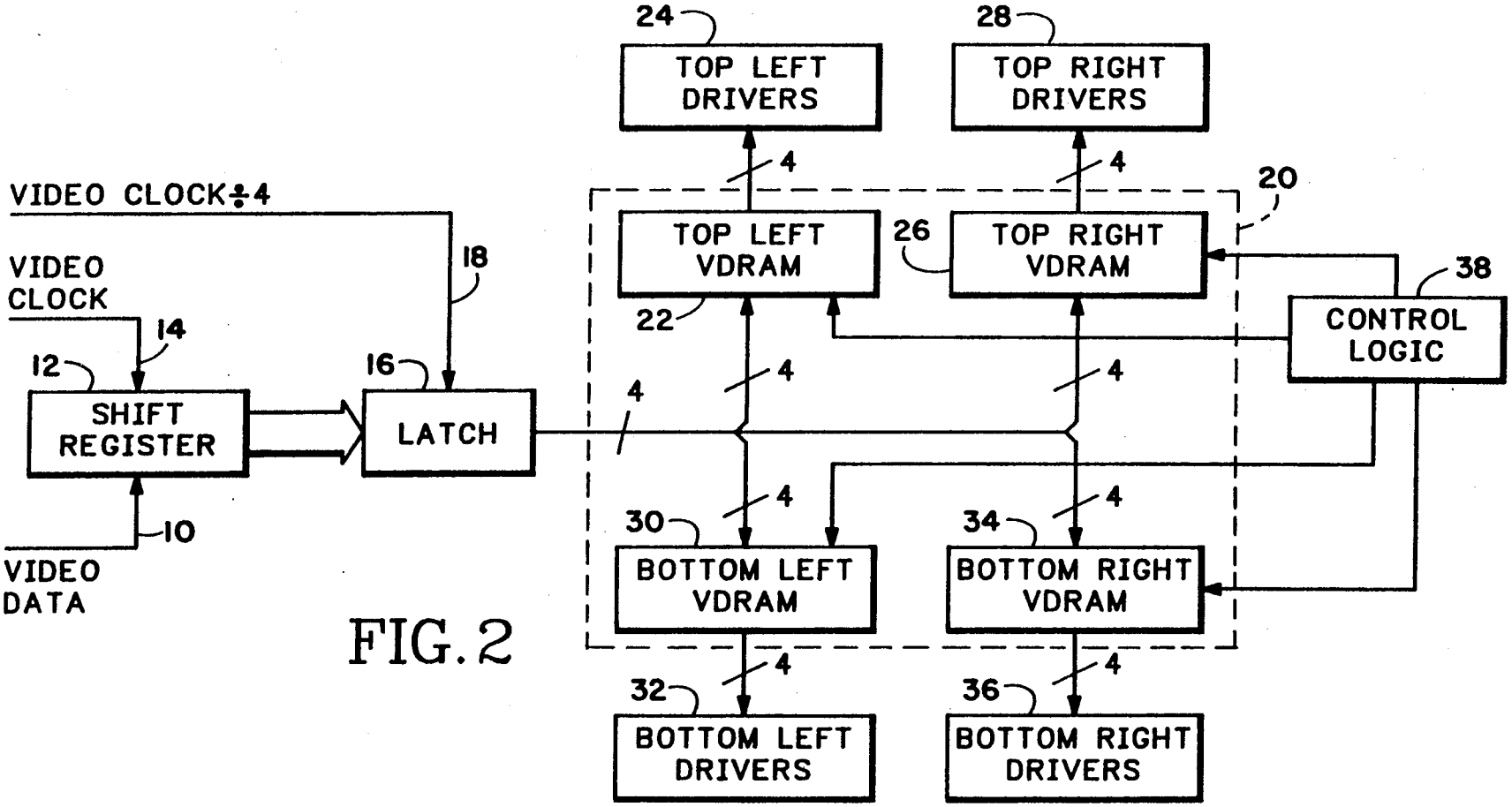
FIG. 2 is a block schematic diagram of the video RAM and data output blocks of FIG. 1.

Referring to FIG. 2 a video data input line 10 is connected to a shift register 12. The shift register 12 has an input line 14 from a video clock (not shown) which loads data into the shift register one bit at a time at a frequency $f_0$. The shift register has four outputs which are latched in a latching circuit 16 in response to a frequency divided video clock line 18. The frequency divided video clock input is the frequency $f_0$ of the video clock divided by the number of output bits of the shift register, in this case, 4. This frequency, $f_1$, is equal to $f_0/4$. The 4 bits in the latch are provided to a video RAM 20 which has four sections. The top left VDRAM 22 is connected to the top left drivers 24 for the TFEL panel. These drivers are for the column or data electrodes in the top left quadrant of the panel. Similarly, the top right VDRAM 26 is connected to the top right drivers 28. The bottom left VDRAM 30 is connected to the bottom left drivers 32 and the bottom right VDRAM 34 is connected to the bottom right drivers 36.

Each of the VDRAMS 22, 26, 30 and 34 comprise a shift register and a random access memory. Data from the latch circuit 16 is loaded into the appropriate VD RAM's shift register through its latch by control logic 38. When the shift register is filled up (it contains two rows of data), the data is transferred to the memory. From there it is read and transferred to the appropriate set of drivers 24, 28, 32 or 36. The control logic 38 is responsible for loading the video data into the shift registers, writing it into memory and reading the data out from memory.

Figure 1:
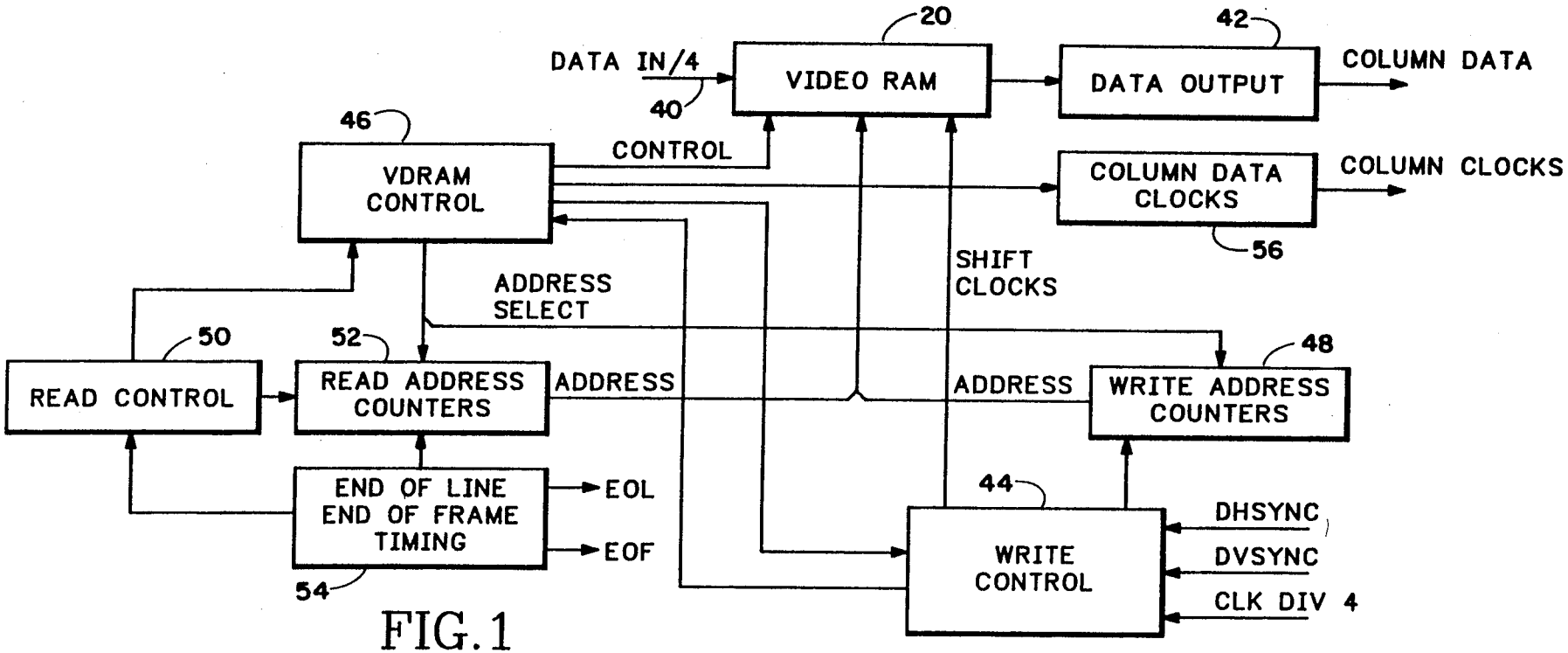
FIG. 1 i a block schematic diagram of a driver network for data electrodes employing the present invention.

The control logic 38 is shown in more detail in FIG. 1. In FIG. 1 the data input line 40 corresponds to the output of latch 16. This line is connected to video ram 20 which has an output connected to data output block 42. Data output block 42 schematically represents a latch and the 4 sets of column drivers 24, 28, 32 and 36. The collective output of data output 42 is 16 bits of column data which are clocked at a rate of 6 MHz. By contrast, data may be input to the video RAM 20 at a 20 MHz rate at four bits per clock. Referring briefly to FIG. 2 the serial input data rate determined by the video clock line 14 is typically on the order of 70 MHz. Thus, the conversion from a serial input to a 16 bit parallel output results in processing the data at a higher rate. The effective output rate is 6 megahertz times 16 bits or 96 MHz as compared to the input rate of 70 MHz. The fact that the column electrodes are independently driven allows 16 bits of data at a time to be processed. Thus, while the clock rate is lower, more data is processed per output clock pulse resulting in a higher refresh rate for the panel. This affords a measure of brightness control for the panel which is dependent on the refresh rate.

As described above the video RAM 20 comprises four separate units 22, 26, 30 and 34, each of which comprise a shift register and a random access memory. A write control 44 includes inputs for delayed horizontal sync, delayed vertical sync and a video clock divided by four. The delayed horizontal sync indicates the beginning of pixel data for a frame and the delayed vertical sync indicates the start of a line of pixel data. The write control 44 includes a "shift clocks" output line which stores the video data into the correct VDRAM 22, 26, 30 or 34. Two rows of data may be stored in each shift register of each of the VDRAMS before data is transferred into the memory portion. This transfer is effected by the VDRAM control 46. A set of write address counters 48 supply an address for the correct memory location to store the data from the shift register portions of each of the individual VDRAMS. A read control 50 commands the VDRAM control 46 to read data from the memory portions of the VDRAMS and controls the number of such reads for the row data. Data is read in four 16 bit words as indicated above. The read control 50 also controls the address counters 52 for the correct read addresses. These counters are similar to the write address counters 48 which supply the addresses of the correct memory locations in the VDRAMS to read the data and supply it to the data output 42. The end-of-line, end-of-frame timing 54 is a constant timing reference for writing to the TFEL panel since the data is not stored in the column drivers at a constant rate. This circuit also controls the row address counting. Column data clocks 56 generate the shift clocks for the column drivers. These clocks are in synchronization with the data and thus validate the data supplied to the column driver ICs. All access to the video RAM 20 is controlled by the VDRAM control 46 which implements the functions of refresh, shift register to memory transfer, the setting of the shift registers for input, and memory read. In this context a "write" function is a shift register to memory transfer.

In the preferred embodiment the data electrodes have been divided into quadrants, top left, top right, bottom left and bottom right, for the purpose of loading data from the video RAM 20. Also, the serial to parallel conversion in shift register 12 occurs at a rate of 4 bits per clock pulse. However, there could be as many independent sets of data electrodes as may be practical, and more than 4 bits per clock pulse could be implemented. Thus in the general sense, there may be n sets of data electrodes and data may be input to the video RAM at a rate of m bits per clock pulse. In such a case the output data from the VDRAM buffers will be at a rate of $n \times m$ per clock pulse where the output clock pulse rate is lower than the input clock pulse rate.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A driving network for an AC TFEL panel including orthoganally disposed sets of scanning and data electrodes sandwiching an electroluminescent laminar structure comprising:

(a) n independently driven sets of data electrodes;

(b) a buffer memory for each of said sets for storing video data;

(c) clock means for storing said video data in said buffer memories at a rate of m bits per clock pulse where the frequency of said clock means is $f_1$:

(d) data output means for asynchronously extracting said video data from said buffer memories at a second clock frequency, $f_2$, wherein $m \times n$ bits are extracted from the buffer memories per clock pulse wherein $f_2$ is less than $F_1$ and wherein $m \times n$ $f_2$ is greater than $mf_1$.

2. The driving network of claim 1 wherein each buffer memory includes a shift register connected to a random access memory.

3. The driving network of claim 1 wherein said clock means includes a shift register for receiving serial input video data at a frequency $f_0$ and a latching circuit connected to an output of the shift register for latching said m bits of video data at said frequency $f_1$ which is equal to $f_o/m$.

4. The driving network of claim 1 wherein n is equal to 4.

5. The driving network of claim 4 wherein m is equal to 4.

* * * * *

UNITED STATES PATENT AND TRADEMARK OFFICE

CERTIFICATE OF CORRECTION

PATENT NO. : 5,010,325

DATED : April 23, 1991

INVENTOR(S) : Michael J. Ziuchkovski

It is certified that error appears in the above-identified patent and that said Letters Patent is hereby corrected as shown below:

Col. 1, line 48, change "fl" to --$f_1$--.

Col. 2, line 33, change "i" to --is--.

Col. 4, line 31, change "orthoganally" to --orthogonally--.

Col. 4, line 39, change colon to semicolon.

Col. 4, line 44, change "$F_1$" to --$f_1$--.

Signed and Sealed this

Twenty-seventh Day of October, 1992

*Attest:*

DOUGLAS B. COMER

*Attesting Officer*

*Acting Commissioner of Patents and Trademarks*